US006628066B1

(12) United States Patent
Eberhardt et al.

(10) Patent No.: US 6,628,066 B1
(45) Date of Patent: Sep. 30, 2003

(54) FLAT GAS DISCHARGE LAMP WITH SPACER ELEMENTS

(75) Inventors: Angela Eberhardt, Augsburg (DE); Michael Ilmer, Rott am Inn (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 23 days.

(21) Appl. No.: 09/937,888

(22) PCT Filed: Oct. 30, 2000

(86) PCT No.: PCT/DE00/04273

§ 371 (c)(1),
(2), (4) Date: Oct. 3, 2001

(87) PCT Pub. No.: WO01/59810

PCT Pub. Date: Aug. 16, 2001

(30) Foreign Application Priority Data

Feb. 7, 2000 (DE) ..... 100 05 156

(51) Int. Cl.[7] ..... H01J 1/62; H01J 17/49; H01J 17/04

(52) U.S. Cl. ..... 313/495; 313/582; 313/631; 313/609

(58) Field of Search ..... 313/609, 610, 313/613, 631, 634, 352, 353–357, 243, 268, 491–494, 495, 497, 582, 583, 586

(56) References Cited

U.S. PATENT DOCUMENTS

| | | | | | |
|---|---|---|---|---|---|
| 4,567,103 | A | * | 1/1986 | Sara | 428/408 |
| 5,004,950 | A | * | 4/1991 | Lee | 313/582 |
| 5,175,473 | A | * | 12/1992 | Kim | 315/169.4 |
| 5,283,498 | A | * | 2/1994 | von Arx et al. | 313/17 |
| 5,453,660 | A | * | 9/1995 | Martin et al. | 313/582 |
| 5,495,142 | A | * | 2/1996 | Hayashi | 313/584 |
| 5,859,502 | A | * | 1/1999 | Spindt et al. | 315/169.3 |
| 6,049,086 | A | * | 4/2000 | Foggiato et al. | 250/504 R |
| 6,246,171 | B1 | * | 6/2001 | Vollkommer et al. | 313/586 |

* cited by examiner

*Primary Examiner*—Nimeshkumar D. Patel
*Assistant Examiner*—German Colón
(74) *Attorney, Agent, or Firm*—Robert F. Clark

(57) ABSTRACT

The invention relates to a flat gas discharge lamp having a discharge vessel and electrodes, the discharge vessel comprising a base plate (1) and a top plate (7) and having at least one spacer element (8) between base plate (1) and top plate (7). Spacer elements usually disrupt the homogeneity of the luminance distribution on the top plate 7. In order to avoid this, the spacer elements (8) are additionally configured as dielectrically impeded electrodes. For this purpose, each spacer element (8) has an electrically conductive component (9) connected to an electrode or current feed. As a result, the spacer elements (8) are actively involved in the discharge and, consequently, in the production of light.

9 Claims, 4 Drawing Sheets

FLAT GAS DISCHARGE LAMP WITH SPACER ELEMENTS

TECHNICAL FIELD

The invention is based on a flat gas discharge lamp according to the preamble of claim 1.

These are, in particular, flat gas discharge lamps, also referred to in brief below as flat lamps, having dielectrically impeded electrodes, as they are known. In this case, the dielectrically impeded electrodes are typically implemented in the form of thin metallic electrode tracks which are arranged on the outer wall and/or inner wall of the discharge vessel. If all the electrodes are arranged on the inner wall, at least some of the electrodes must be completely covered with respect to the interior of the discharge vessel by a dielectric layer.

Flat lamps of this type are used, for example, for backlighting liquid crystal displays (LCD) or else for general lighting, decorative and advertising purposes.

Otherwise, the technology of flat gas discharge lamps for dielectrically impeded discharges is assumed here as the prior art. As an example, reference is additionally made to the specification WO98/43277, whose disclosure content with regard to the lamp technology of flat gas discharge lamps for dielectrically impeded discharges is hereby incorporated by reference.

PRIOR ART

Flat gas discharge lamps of the generic type typically have two discharge vessel walls which, at least in some areas and approximately, are planar and are adjacent and parallel to one another.

These two vessel walls, referred to below as the top plate and base plate for brevity, are usually connected to each other in a gastight manner by a frame and in this way form the discharge vessel. Alternatively, the base plate and/or top plate can be formed in such a way that when they are joined together a discharge vessel is already formed. For example, the base plate and/or top plate can be of trough-like form, for example as a result of deep-drawing a planar glass plate. In the case of very large-area flat lamps, the predominant proportion of the shaped base plate and top plate, respectively, is at least approximately planar in this case as well. In any case, a lamp of this type needs one or more supporting points, also referred to below as spacer elements, for the purpose of stabilization.

This is all the more true since a discharge lamp has a gas filling of defined composition and with a filling pressure and therefore has to be evacuated before being filled. Consequently, the discharge vessel must permanently withstand both vacuum—specifically during production of the lamp—and the subsequent filling pressure which, in the case of lamps of this type, is usually less than atmospheric pressure, for example between 10 kPa and 20 kPa. This is achieved by means of the aforementioned spacer elements, which are arranged in a sufficient number and suitable position between the base plate and front plate of the discharge vessel. In this case, each spacer element touches two mutually opposite supporting surfaces on the two plates and in this way supports them mutually.

When positioning the spacer elements, account has primarily to be taken of the stability of the arrangement. In addition, it is necessary to take care that the discharge is not influenced, or at most, slightly. In this respect reference is made to the specification WO99/54916. The spacer elements used there consist of a dielectric material, for example a soft glass or a ceramic.

The disadvantage is that the spacers are imaged as relatively dark spots in the luminous front plate of the lamp. As a result, the homogeneity of the luminance of the lamp is impaired. This is unacceptable, in particular in the case of backlighting liquid crystal displays. For this reason, optical diffusers, for example diffuser films, are usually used between the flat lamp and the liquid crystal displays. However, diffuser films of this type have transmission losses, as a result of which the effective luminance decreases. The aim is, therefore, to manage with as few diffuser films as possible, or, ideally, to dispense with diffusers completely.

SUMMARY OF THE INVENTION

It is an object of the present invention to provide a flat gas discharge lamp having spacer elements according to the preamble of claim 1, in which the spacer elements impair the homogeneity of the luminance of the lamp as little as possible.

In a lamp having the features of the preamble of claim 1, this object is achieved by the features of the characterizing part of claim 1.

Particularly advantageous refinements are to be found in the dependent claims.

According to the invention, the at least one spacer element arranged between the base plate and top plate of the discharge vessel of a flat lamp is additionally configured as a dielectrically impeded electrode. In other words, a spacer element of this type not only performs a supporting function, as in the prior art, but also an electrode function in addition.

In this way, during the operation of the lamp, a discharge burns between the spacer element and an adjacent electrode of opposite polarity. This electrode can also be a further such spacer element with an additional electrode function according to the invention. For the action aimed at according to the invention, it is essential only that a discharge starts up directly on the spacer element or on each spacer element. As a result, the relevant spacer element, so to speak, specifically contributes actively to the generation of light. In this case, it has been shown that the spacer elements modified in this way themselves light up in a certain way, in each case such that the inhomogeneity in the luminance normally caused by the spacer elements can either be avoided virtually completely or at least can be reduced considerably.

A spacer element according to the invention has both a first dielectric component and, in addition, an electrically conductive second component. In this case, the second component can also extend along the entire longitudinal extent of the spacer element, but does not necessarily have to do so but can instead also be restricted to only a part. For the additional function as a dielectrically impeded electrode, it is merely essential for the second, that is to say electrically conductive, component to be separated from the interior of the discharge vessel by the first dielectric component. For the function as a supporting point, it is additionally necessary for the spacer element—at least the dielectric component—to extend from the base plate to the top plate.

For the second electrically conductive component, a round or flat wire, a strip-like film or the like is particularly suitable. In this case, the first component consists of an insulating material, for example a glass sheath, in which the wire is enclosed. The first dielectric component does not necessarily have to be in one piece or consist of a single material. With regard to the supporting function, it may be advantageous if the spacer element consists of at least two materials of different hardnesses. In this regard, reference is made to the specification DE 198 17 478 A1, whose disclosure content is hereby incorporated by reference.

Alternatively, the two components can also consist of a metal/glass composite. In this case, it is advantageous if the concentration of the metal powder increases from the outside to the inside.

The spacer elements modified in accordance with the invention can supplement the actual electrodes, that is to say be arranged in addition to the latter, or can replace these, at least partially or even completely. In addition, the modified spacer elements can be used on their own or else together with conventional spacer elements.

The modified spacer elements, that is to say the electrically conductive second components, are electrically conductively connected to the current feeds to the flat lamp or to the actual electrodes. Of course, each spacer must be connected only to one electrical polarity in order to develop the desired additional electrode function.

If the electrodes of the flat lamp are configured as electrode tracks which are arranged on the inner surface of at least one of the two vessel plates, it has proven to be beneficial to arrange the modified spacer elements directly on the electrode tracks.

In order to facilitate the ignition of a discharge between the spacer elements of different polarity modified in accordance with the invention, or in order to permit it at all, the mutual spacing of the electrically conductive components is preferably less than the mutual spacing of the corresponding electrode tracks.

The solution according to the invention has the advantage of an improved homogeneity, which also permits the omission of an optical diffuser, associated with cost savings and a low overall height. In addition, the discharge between the spacer elements modified in accordance with the invention is considerably further removed from the base plate than is the case in typical flat lamps with electrode tracks arranged on the inner side of the top plate. As a result, the discharge vessel is heated less, and a phosphor layer which may be applied to the base plate is damaged less.

DESCRIPTION OF THE DRAWINGS

In the following text, the invention will be explained in more detail using a number of exemplary embodiments. The individual features disclosed may also be essential to the invention in other combinations. In the drawing:

FIG. 1 shows a base plate 1 of a flat lamp having electrode tracks 2, 3 and spacer elements 4 according to the prior art. The spacer elements 4 used are balls 4 of soft glass with a diameter of 5 mm. They are largely uniformly distributed on the base plate and arranged between the electrode tracks 2, 3. In addition, a frame 5 of the discharge vessel, connected to the base plate, is indicated. A top plate (not illustrated) is likewise connected to the frame 5 and in this way completes the flat discharge vessel.

Figure 1:
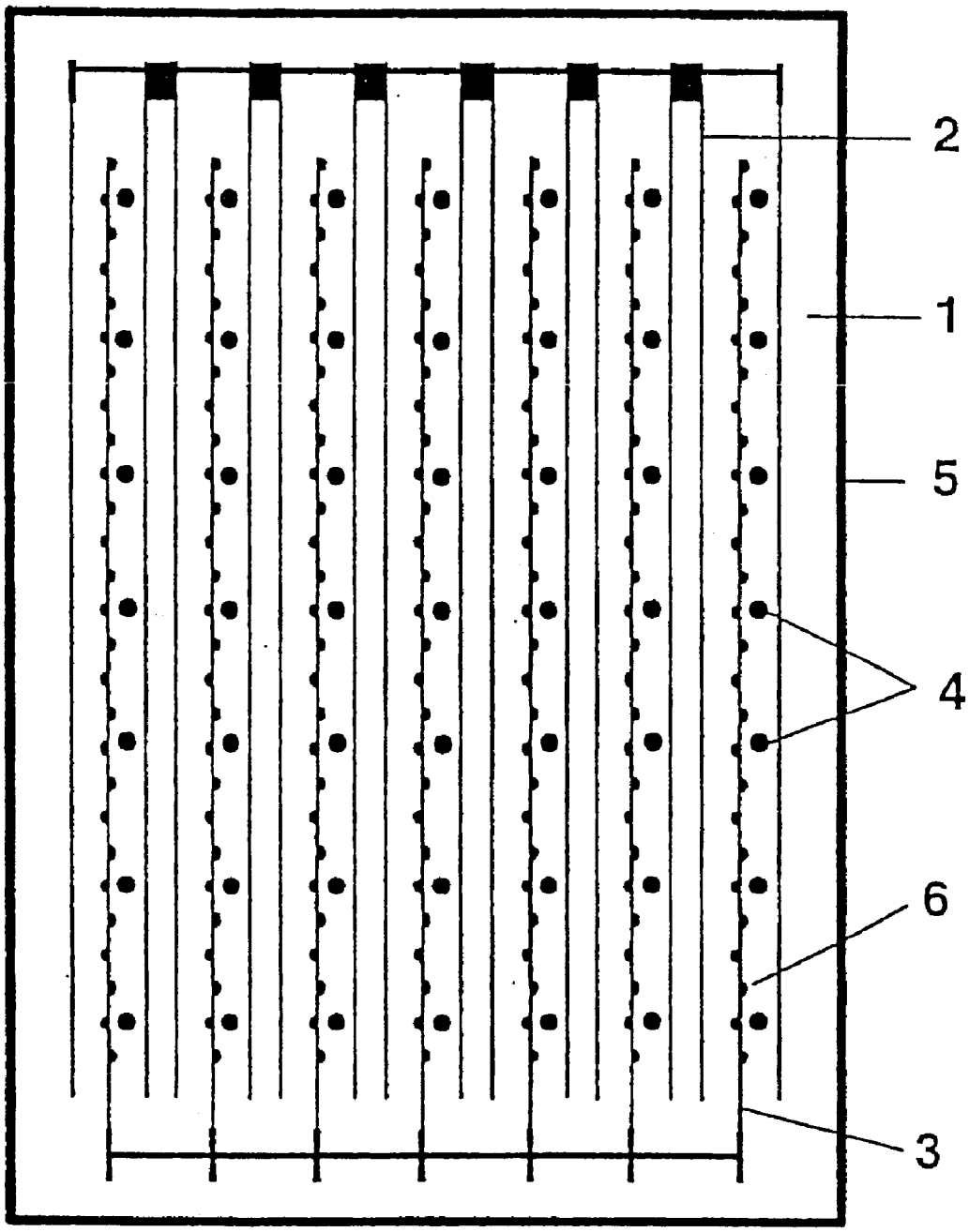
FIG. 1 shows a base plate of a flat lamp having electrode tracks and spacer elements according to the prior art.

The glass balls 4 are soldered onto the base plate 1 by a glass solder, in order to fix them during assembly. They merely rest on the top plate 2 (not illustrated). For further details, reference is made to the specification WO99/54916 already cited, in particular to FIG. 1 with the associated description.

The double electrode tracks 2 are provided as anodes and the electrode tracks 3 provided with nose-like structures 6 are provided as cathodes. For details on the electrode tracks, reference is made to the specification WO98/43276. In addition, current feeds (not illustrated) are also provided for the electrode tracks 2, 3.

The following exemplary embodiments according to the invention are preferably provided for the pulsed mode of operation described in the specification WO94/23442. The disclosure content of this specification in this regard is hereby incorporated by reference.

In addition, the inner sides of the discharge vessel walls are provided with a phosphor layer, which is not illustrated below, for simplicity. The phosphor layer converts the UV radiation typically produced by the gas discharge into visible light; in the example of a discharge in xenon, this radiation is the xenon excimer radiation with an intensity maximum in the emission bands at about 172 nm.

Figure 2A:
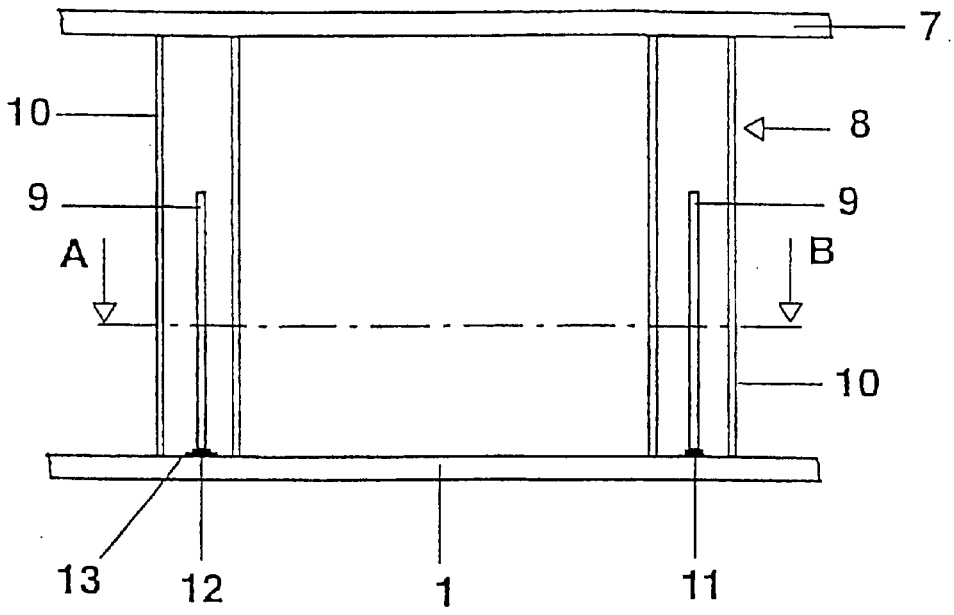
FIG. 2*a* shows a side view of a first exemplary embodiment according to the invention.
Figure 2B:
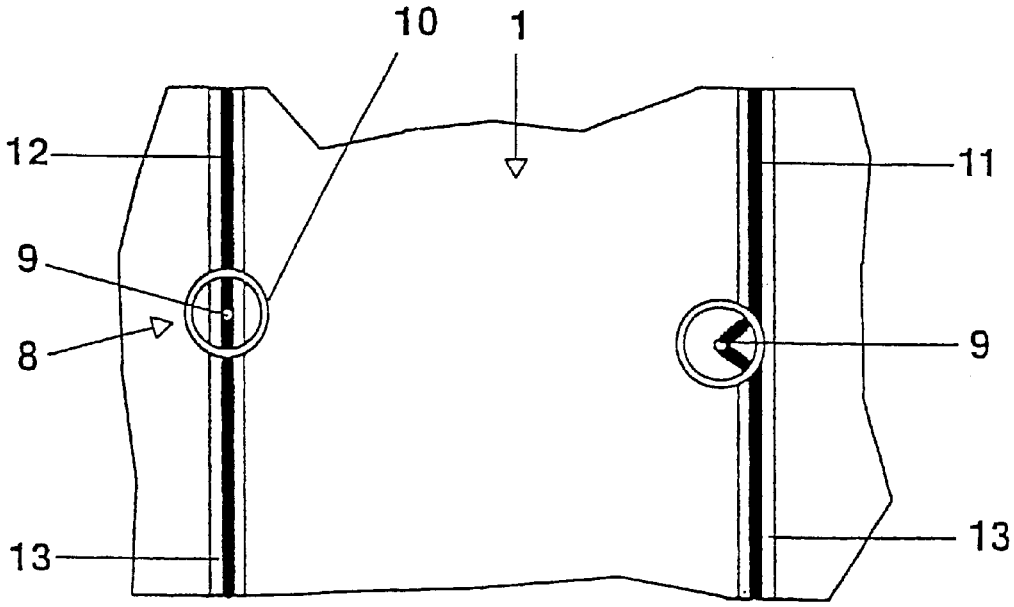
FIG. 2*b* shows a view along the line AB of the exemplary embodiment from FIG. 2*a,*

FIGS. 2*a*, 2*b* show, as details, a side view and a view sectioned along the line AB of an exemplary embodiment according to the invention in a schematic illustration. The basic type corresponds to that from FIG. 1, with the exception of the spacer elements 8 extending between the base plate 1 and top plate 7. These each have a metal wire 9, which extends approximately over half the vertical extent of the spacer element 8. The metal wire 9 is sheathed by a circularly cylindrical glass column 10. The glass sheathing 10 is used as a dielectric component, which separates the metal wire 9—the electrically conductive second component—from the interior of the discharge vessel. Each spacer element 8 is arranged above an electrode track 11 or 12 in such a way that in each case the metal wire 9 is electrically conductively connected to the corresponding electrode track 11 or 12.

The mutual spacing of two metal wires 9 of different polarity is less than the mutual spacing of the associated electrode track 11 and 12. This ensures that—as desired—a discharge impeded dielectrically by the glass sheathing 10 burns between these wires 9 and not, for example, only between the two electrode tracks 11, 12. Otherwise, the electrode tracks 11, 12 are each covered by a thin glass layer 13, which acts as a dielectric impediment. In addition, the electrode tracks 11, 12 can also have nose-like structures as in FIG. 1, in order to assist in a specific manner the formation of discharges at specific points between these electrode tracks 11, 12.

Of course, the actual number of spacer elements 8 is primarily proportional to the two-dimensional extent of the flat lamp and the criterion of adequate mechanical stability.

Figure 3A:
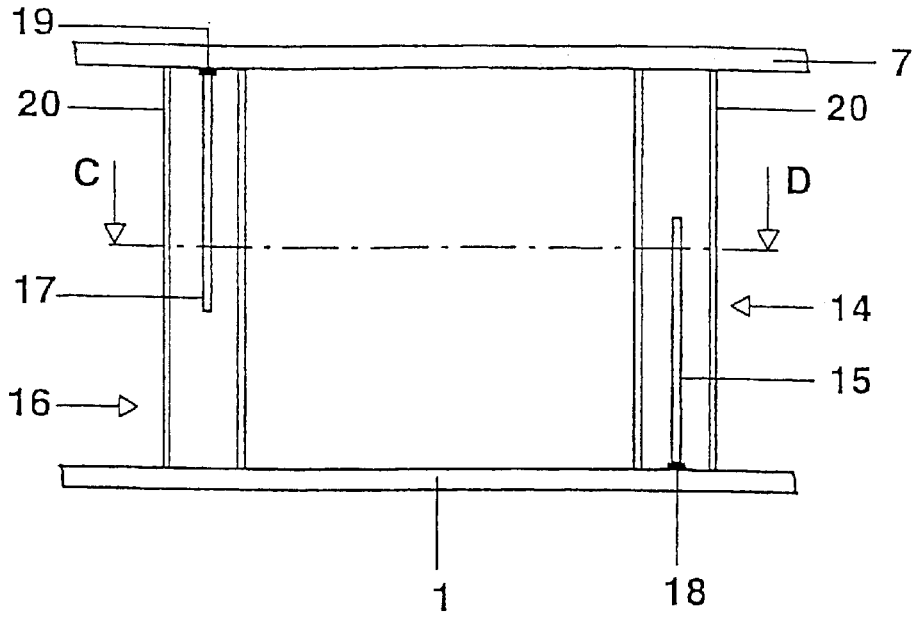
FIG. 3*a* shows a side view of a second exemplary embodiment according to the invention.
Figure 3B:
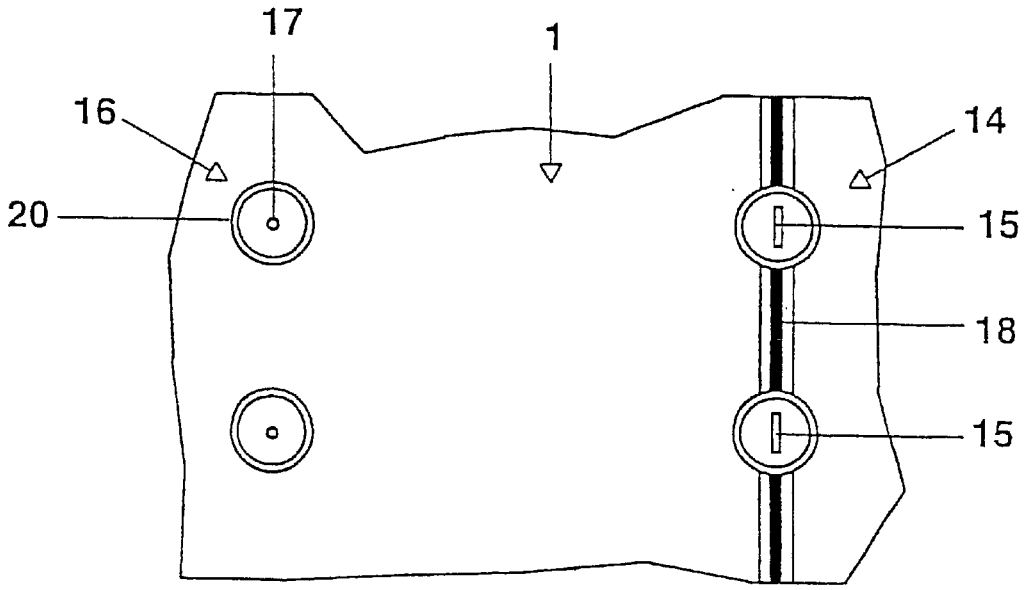
FIG. 3*b* shows a view along the line CD of the exemplary embodiment from FIG. 3*a,*

FIGS. 3*a*, 3*b* show, as details, a side view and a view sectioned along the line AB of a second exemplary embodiment in a schematic illustration. Arranged between the base plate 1 and top plate 7 again are spacer elements 14, 16 made of circularly cylindrical glass rods 20. A first part of these spacer elements 14 additionally has electric components, which are formed as strip-like metal foils 15. These are in each case fused into one of the glass rods 20, beginning at one end and extending approximately to the center of the respective spacer element 14. A second part of the spacer elements 16 has electrical components, which are formed as metal wires 17. These are in each case each likewise fused into one of the glass rods 20, beginning at one end and extending approximately to the center of the respective spacer element 16. Electrode tracks 18 of a first polarity are arranged parallel to one another with a mutual spacing on the inner side of the base plate 1. Electrode tracks 19 of the other polarity are arranged on the inner side of the top plate 7 (which cannot be seen in FIG. 3*b*), in each case alternately parallel to and offset with respect to the electrode tracks 18 of the first polarity. The metal foils 15 are connected to the electrode tracks 18 of the base plate 1, and the metal wires 17 are connected to the electrode tracks 19 of the top plate 7. In this way, during pulsed operation, dielectrically impeded discharges in each case burn between the spacer elements 14, 16 of different polarity, in the manner explained in the specification WO94/23442 already cited.

Figure 4:
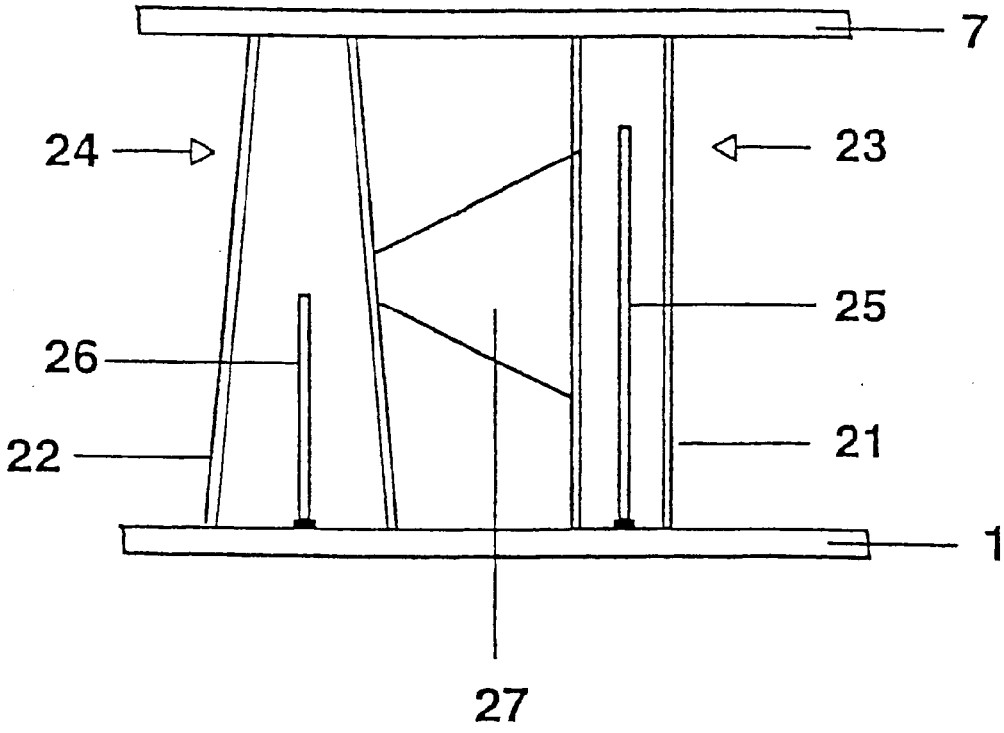
FIG. 4 shows a variant according to the invention of the exemplary embodiment in FIGS. 2*a*, 2*b*.

FIG. 4 shows, in a detailed illustration, a variant of the exemplary embodiment of FIGS. 2*a*, 2*b*. Here, metal wires 25, 26 of different lengths are fused into the glass rods 21, 22 of the spacer elements 23, 24 of different polarity. In addition, the glass rods 21 having the longer metal wires 25 are cylindrical, the glass rods 22 having the shorter metal wires 26, on the other hand are conical. As a result, the individual discharge 27 which in each case burns between spacer elements of different polarity can be influenced in terms of its characteristics, for example its shape and position.

What is claimed is:

1. A flat gas discharge lamp comprising a discharge vessel and dielectrically-impeded electrode tracks, the discharge vessel having a top plate, a base plate and spacer elements extending from the top plate to the base plate, the electrode tracks being arranged in parallel on at least one of the plates;

each spacer element comprising an electrically conductive component and a dielectric component, the dielectric component separating the electrically conductive component from the interior of the discharge vessel, the electrically conductive component extending at least partially along the longitudinal extent of the spacer element and being electrically connected to an electrode track;

at least one of the spacer elements being electrically connected to an electrode track of a first polarity and at least one spacer element being electrically connected to an electrode track of an opposite polarity, the mutual spacing between adjacent spacer elements of different polarity being less than the mutual spacing of the corresponding electrode tracks to which the adjacent spacer elements of different polarity are connected so that a discharge may be formed between the adjacent spacer elements of different polarity; and wherein the dielectric component of each spacer element is a circularly cylindrical glass column and the electrically conductive component of each spacer element is a metal wire.

2. The flat gas discharge lamp of claim 1 wherein the metal wire of each spacer element extends approximately over half the longitudinal extent of the spacer element.

3. A flat gas discharge lamp comprising a discharge vessel and dielectrically-impeded electrode tracks, the discharge vessel having a top plate, a base plate and spacer elements extending from the top plate to the base plate, the electrode tracks being arranged in parallel on at least one of the plates;

each spacer element comprising an electrically conductive component and a dielectric component, the dielectric component separating the electrically conductive component from the interior of the discharge vessel, the electrically conductive component extending at least partially along the longitudinal extent of the spacer element and being electrically connected to an electrode track;

at least one of the spacer elements being electrically connected to an electrode track of a first polarity and at least one spacer element being electrically connected to an electrode track of an opposite polarity, the mutual spacing between adjacent spacer elements of different polarity being less than the mutual spacing of the corresponding electrode tracks to which the adjacent spacer elements of different polarity are connected so that a discharge may be formed between the adjacent spacer elements of different polarity; and wherein the electrically conductive component and the dielectric component comprise a metal/glass composite wherein the concentration of the metal increases from the outside to the inside of each spacer element.

4. A flat gas discharge lamp comprising a discharge vessel and dielectrically-impeded electrode tracks, the discharge vessel having a top plate, a base plate and spacer elements extending from the top plate to the base plate, the electrode tracks being arranged in parallel on at least one of the plates;

each spacer element comprising an electrically conductive component and a dielectric component, the dielectric component separating the electrically conductive component from the interior of the discharge vessel, the electrically conductive component extending at least partially along the longitudinal extent of the spacer element and being electrically connected to an electrode track;

at least one of the spacer elements being electrically connected to an electrode track of a first polarity and at least one spacer element being electrically connected to an electrode track of an opposite polarity, the mutual spacing between adjacent spacer elements of different polarity being less than the mutual spacing of the corresponding electrode tracks to which the adjacent spacer elements of different polarity are connected so that a discharge may be formed between the adjacent spacer elements of different polarity; and wherein some spacer elements are conical and some spacer elements are cylindrical.

5. The flat gas discharge lamp of claim 4 wherein the electrically conductive component of each spacer element is a metal wire and the metal wire in the conical spacer elements are shorter than the metal wire in the cylindrical spacer elements.

6. The flat gas discharge lamp of claim 4 wherein the conical spacer elements have a different polarity than the cylindrical spacer elements.

7. A flat gas discharge lamp comprising a discharge vessel and dielectrically-impeded electrode tracks, the discharge vessel having a top plate, a base plate and spacer elements extending from the top plate to the base plate, the top plate having mutually parallel electrode tracks of a first polarity arranged thereon, the base plate having mutually parallel electrode tracks of an opposite polarity arranged thereon, the electrode tracks of the top plate being parallel to and offset from the electrode tracks on the base plate;

each spacer element comprising an electrically conductive component and a dielectric component, the dielectric component separating the electrically conductive component from the interior of the discharge vessel, the electrically conductive component extending at least partially along the longitudinal extent of the spacer element and being electrically connected to an electrode track;

at least one spacer element being electrically connected to an electrode track of the first polarity and at least one spacer element being electrically connected to an electrode track of the opposite polarity so that a discharge may be formed between adjacent spacer elements of different polarity.

8. The flat gas discharge lamp of claim 7 wherein the metal wire of each spacer element extends approximately over half the longitudinal extent of the spacer element.

9. The flat gas discharge lamp of claim 8 wherein the electrically conductive component of the at least one spacer element of the first polarity is a metal wire and the electrically conductive component of the at least one spacer element of the opposite polarity is a metal foil.

* * * * *